US008136687B2

(12) United States Patent
Wu

(10) Patent No.: US 8,136,687 B2
(45) Date of Patent: Mar. 20, 2012

(54) COVER OF CONTAINER

(76) Inventor: Hung Kuan Wu, Taipei (TW)

( * ) Notice: Subject to any disclaimer, the term of this patent is extended or adjusted under 35 U.S.C. 154(b) by 391 days.

(21) Appl. No.: 12/461,832

(22) Filed: Aug. 26, 2009

(65) Prior Publication Data

US 2011/0049082 A1 Mar. 3, 2011

(51) Int. Cl.

| | |
|---|---|
| ***A61J 1/03*** | (2006.01) |
| ***B65D 41/00*** | (2006.01) |
| ***B65D 43/00*** | (2006.01) |
| ***B65D 41/04*** | (2006.01) |
| ***B65D 51/18*** | (2006.01) |

(52) U.S. Cl. ..... 220/254.1; 215/206; 215/208; 215/230; 215/332; 215/334; 220/253; 220/259.3; 220/786; 220/790; 221/151; 221/152

(58) Field of Classification Search ..... 215/206, 215/208, 230, 332, 334; 220/254.1, 259.3, 220/253, 786, 790; 221/151, 152
See application file for complete search history.

(56) References Cited

U.S. PATENT DOCUMENTS

| | | | | |
|---|---|---|---|---|
| 5,099,999 | A * | 3/1992 | Balien | 206/536 |
| 5,520,307 | A * | 5/1996 | Miller et al. | 221/2 |
| 5,579,933 | A * | 12/1996 | Hofmann | 215/220 |
| 5,947,345 | A * | 9/1999 | Hofmann | 222/519 |
| 7,857,134 | B2 * | 12/2010 | Koch | 206/534 |

* cited by examiner

*Primary Examiner* — Anthony Stashick
*Assistant Examiner* — Madison L Wright
(74) *Attorney, Agent, or Firm* — Rosenberg, Klein & Lee

(57) ABSTRACT

A cover of a container is provided. The cover displays the number of times a user has ever opened the container which contains medication to thereby inform the user of the user's history of medication use with a view to protecting the user from unnecessary repeat medication and suggesting the user to take medication.

1 Claim, 4 Drawing Sheets

A-A

B-B

C-C

D-D

COVER OF CONTAINER

BACKGROUND OF THE INVENTION

1. Technical Field

The present invention relates to covers of containers, and more particularly, to a medication container's cover for displaying the number of times a user has ever opened the medication container and thereby informing the user of the user's history of medication use so as to protect the user from unnecessary repeat medication and from taking wrong medication, and remind the user to take medication.

2. Description of Related Art

In general, the mouth of a conventional medication container is usually too large to allow an exact number of pills to be drawn from the medication container or to prevent pills from sluicing out of the mouth of the medication container or spilling all over the ground. As a result, the medication container lacks ease of use, and the pills therein are likely to end up being contaminated. Considering that there is still room for improvement on the prior art, the inventor of the present invention develops a cover structure for preventing the aforesaid drawbacks of the prior art. The inventor filed a Taiwanese utility model application (Application No. 98202822, entitled Cover of Container) and a U.S. patent application (U.S. Ser. No. 12/292,221, entitled Container) for the cover structure she invented. Then, the Taiwanese utility model application was allowed, and the inventor was granted Taiwan Utility Model No. M359519.

Afterward, to improve on the patented utility model, the inventor further studied the prior art and interviewed medical professionals and patients to understand their needs. The interviews reveal that patients are susceptible to unnecessary repeat medication or, conversely, neglect to take medication as prescribed because they are seldom sure whether they have taken medication as prescribed.

Considering that there is still room for improvement on the prior art, the inventor improves the patented utility model and thereby puts forth the present invention with a view to meeting user needs.

BRIEF SUMMARY OF THE INVENTION

The present invention provides a cover of a container, and more particularly, a cover of a medication container, wherein the cover displays the number of times a user has ever opened the container to thereby inform the user of the user's history of medication use with a view to protecting the user from unnecessary repeat medication and reminding the user to take medication.

The present invention is devised by improving on Taiwan Utility Model No. M359519, entitled Cover of Container, and the corresponding U.S. patent application (U.S. Ser. No. 12/292,221, entitled Container) filed, previously and simultaneously, by the inventor of the present invention.

DETAILED DESCRIPTION OF THE INVENTION

Figure 1:
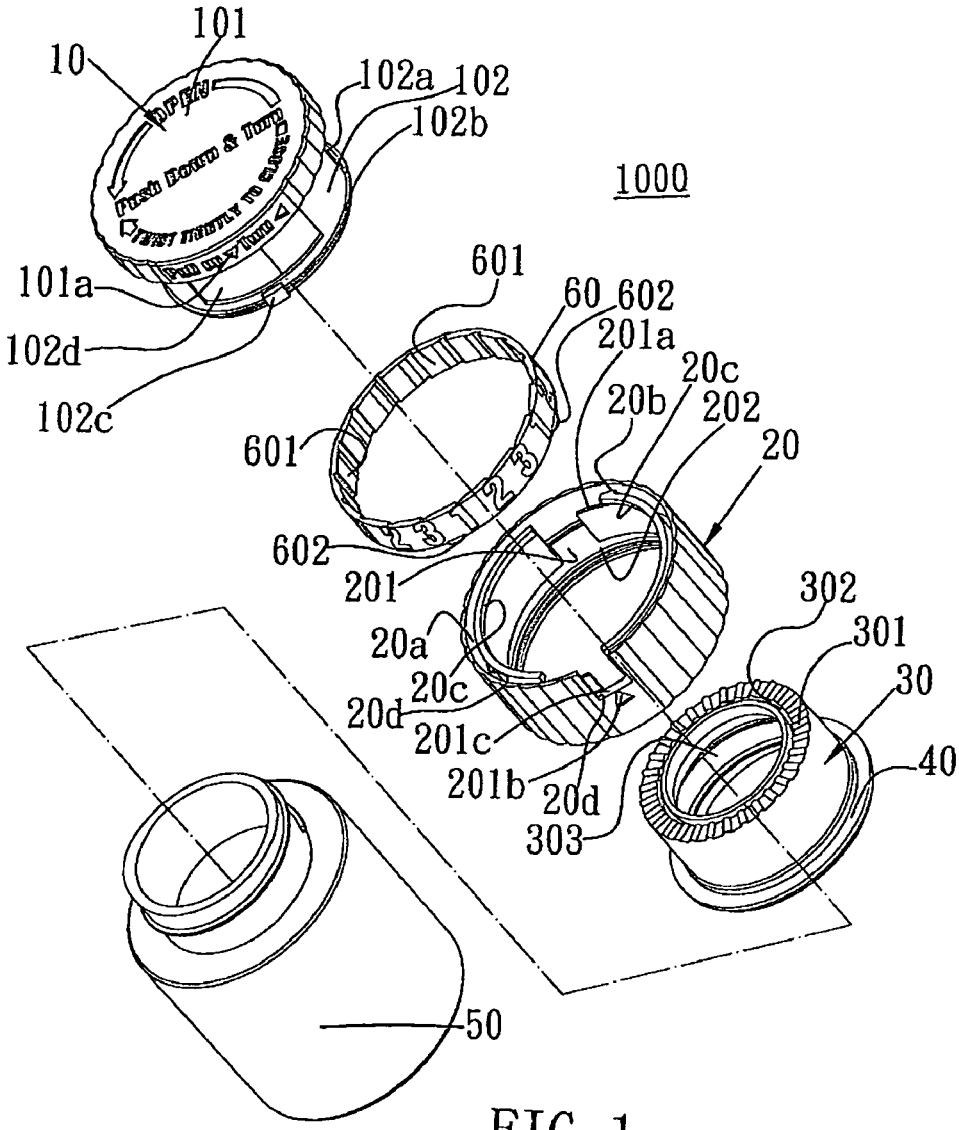
FIG. 1 is an exploded view of a cover of a container according to the present invention.

Referring to FIG. 1, an exploded view of a cover of a container according to the present invention is shown, and the cover comprises the following constituent elements.

A movable lid 10 (see also FIGS. 2 and 3) comprises: a table portion 101; a cylinder portion 102 extending from the bottom of the table portion 101; slits 102*a* provided at diametric positions of the cylinder portion 102 respectively; a flange 102*b* provided at the bottom of the cylinder portion 102; a bump 102*c* protrudingly provided at the flange 102*b*; a projection 103 protrudingly provided at the flange 102*b*, wherein the bump 102*c* and the projection 103 are provided at diametric positions of the flange 102*b* respectively; an opening 102*d* provided on the front of the cylinder portion 102; a sign 110*a* protrudingly provided at the rim of the table portion 101 and vertically corresponding in position to the bump 102*c* of the cylinder portion 102, wherein an upper circumferential serrate portion 101*b* and a protruding ring 101*c* are provided at the bottom of the table portion 101 and enclosed by the cylinder portion 102.

Figure 4:
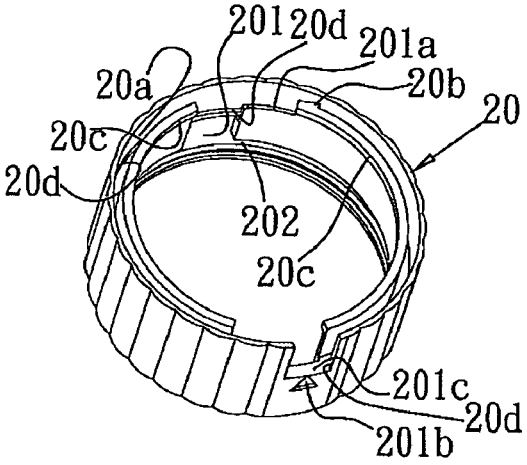
FIG. 4 is a perspective view of the outer ring according to the present invention.
Figure 5:
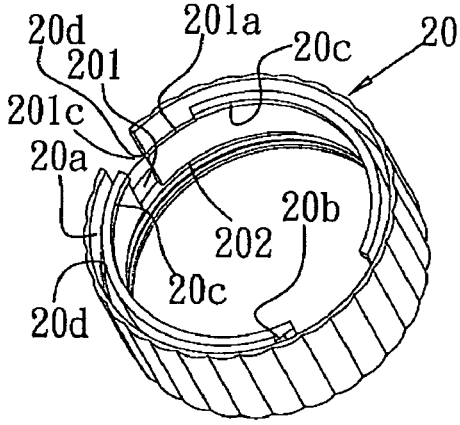
FIG. 5 is another perspective view of the outer ring according to the present invention.

An outer ring 20 (see also FIGS. 4 and 5) assumes an annular shape and has an annular groove 20*a* provided at the top of the outer ring 20. An annular track 20*d* is indently provided on the bottom side of the annular groove 20*a*. A hook 20*b* is protrudingly provided on the inner wall of the annular groove 20*a*. Two vertical channels 201 are indently provided at diametric positions on the inner annular side of the outer ring 20. An insertion channel 201*a* transversely extends from the end of each of the vertical channels 201. An annular dent portion 202 is indently provided at the lower portion of the inner annular side of the outer ring 20. A sign 201*b* is protrudingly provided at the rim of the outer ring 20. A notch 201*c* is provided at the rim of the outer ring 20. The sign 201*b* and the notch 201*c* correspond in position to the vertical channels 201. A protruding top flange 20*c* is provided at the upper portion of the inner annular side of the outer ring 20.

Figure 6:
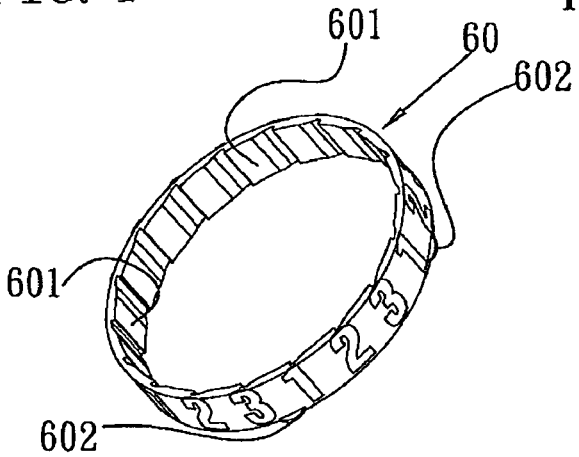
FIG. 6 is a perspective view of the symbol ring according to the present invention.

A symbol ring 60 (see also FIGS. 1 and 6) is provided. A plurality of signs and a plurality of bumps 602 are provided on the outer annular side of the symbol ring 60. A plurality of barbs 601 are protrudingly provided on the inner annular side of the symbol ring 60. The symbol ring 60 is configured to be positioned inside the annular groove 20*a* of the outer ring 20.

Figure 1A:
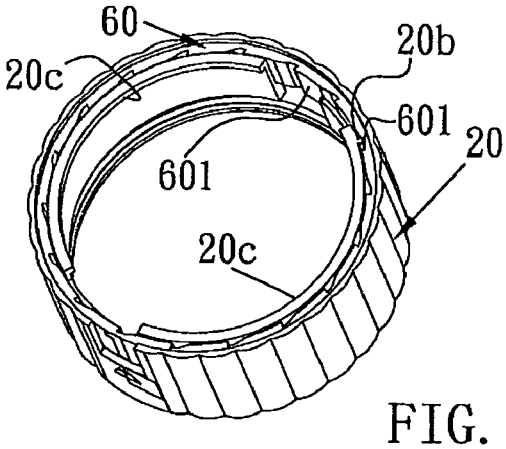
FIG. 1A is a perspective view of an outer ring and a symbol ring coupled to each other according to the present invention.
Figure 10:
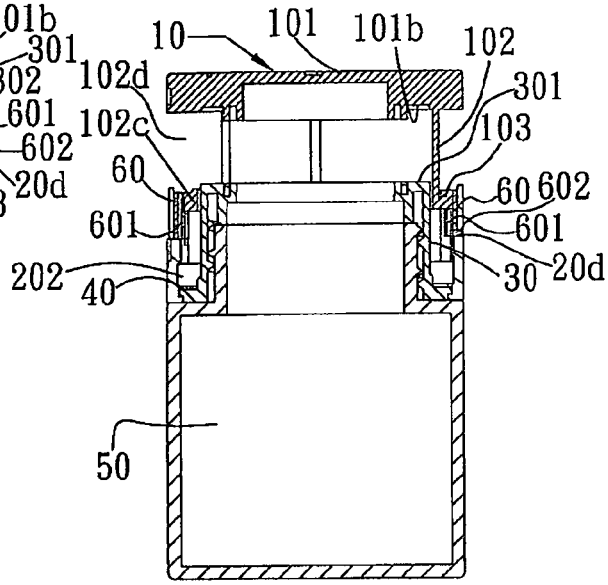
FIG. 10 is a cross-sectional view of a cover of a container taken along line B-B of FIG. 7 according to the present invention.

Referring to FIGS. 1A, 10, abutting the hook 20*b* in the annular groove 20*a* and a corresponding one of the barbs 601 of the symbol ring 60 against each other and positioning the bumps 602 in the annular track 20*d* of the annular groove 20*a* enables unidirectional rotation of the symbol ring 60 but prevents the release thereof.

Figure 2:
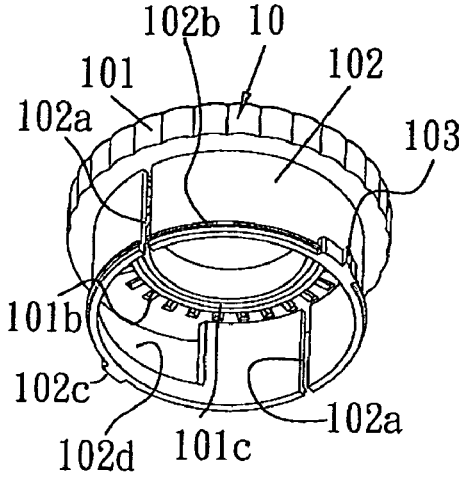
FIG. 2 is a perspective view of a movable lid according to the present invention.
Figure 3:
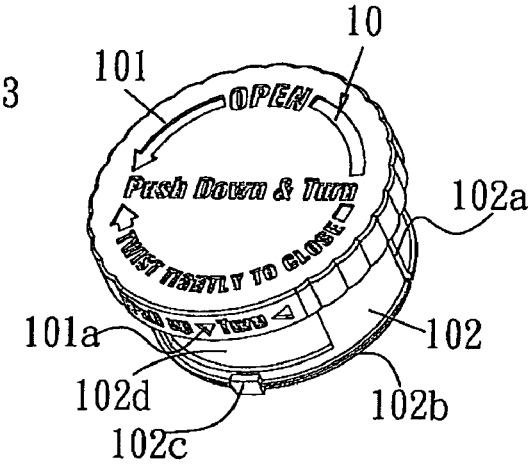
FIG. 3 is another perspective view of the movable lid according to the present invention.
Figure 9:
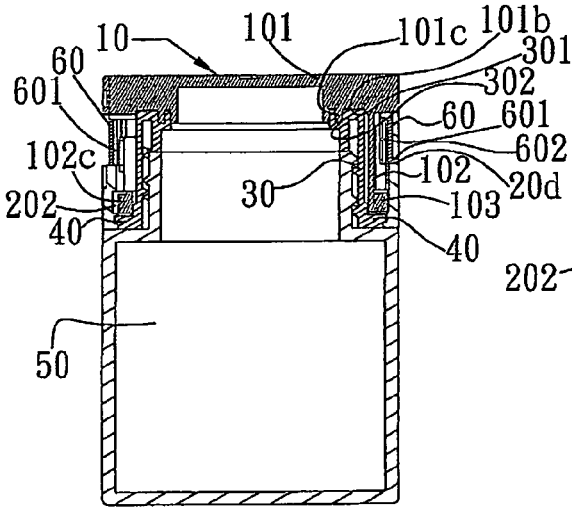
FIG. 9 is a cross-sectional view of a cover of a container taken along line A-A of FIG. 7 according to the present invention.

An inner lid 30 is provided. A lower circumferential serrate portion 301 is provided at the top of the inner lid 30. An annular dent portion 302 is provided at the inner rim of the lower circumferential serrate portion 301. A hollow core 303 is centrally provided in the inner lid 30. Referring to FIGS. 2 and 9, the lower circumferential serrate portion 301 is configured to engage with the upper circumferential serrate portion 101*b* provided at the bottom of the table portion 101 of the movable lid 10. The annular dent portion 302 is configured to engage with the protruding ring 101*c* provided at the bottom of the table portion 101 of the movable lid 10. An annular flange 40 is provided at the lower rim of the inner lid 30 such that the bottom of the outer ring 20 engages with the annular flange 40 of the inner lid 30.

The symbol ring 60 is configured to be positioned inside the annular groove 20*a* of the outer ring 20, such that the bumps 602 of the symbol ring 60 are positioned inside the annular track 20*d* of the annular groove 20*a*. Hence, the symbol ring 60 is rotatable within the annular groove 20*a* without being released therefrom. Afterward, the cylinder portion 102 of the movable lid 10 is inserted into the symbol ring 60. During the inserting process, the slits 102*a* provided at diametric positions of the cylinder portion 102, respectively, provide room for contraction of the cylinder portion 102 to thereby facilitate the insertion of the cylinder portion 102 into the symbol ring 60. The flange 102*b*, the bump 102*c*, and the projection 103 provided at the bottom of the cylinder portion 102 together engage with the annular dent portion 202 indently provided at the lower portion of the inner annular side of the outer ring 20 to thereby prevent the movable lid 10 from separating from the outer ring 20 and yet permit axial rotation of the movable lid 10. Afterward, the movable lid 10 and the outer ring 20 together rest on the inner lid 30 to thereby allow the lower circumferential serrate portion 301 and the annular dent portion 302 of the inner lid 30 to engage with the upper circumferential serrate portion 101*b* and the protruding ring 101*c* both provided at the bottom of the table portion 101 of the movable lid 10, and in consequence the annular flange 40 provided at the lower rim of the inner lid 30 is engaged with and fixed in position to the bottom of the outer ring 20 to thereby form a cover 1000. The cover 1000 thus formed is configured to couple with and hermetically seal the mouth of a container 50.

The flange 102*b*, the bump 102*c*, and the projection 103 of the cylinder portion 102 of the movable lid 10 engage with the annular dent portion 202 indently provided at the lower portion of the inner annular side of the outer ring 20 to thereby prevent the movable lid 10 from separating from the container 50 and yet permit axial rotation of the movable lid 10; hence, the movable lid 10 is prevented from being pulled upward and thus is locked to the container 50. The movable lid 10 can be lifted and unlocked from the container 50, provided that the movable lid 10 is rotated until the bump 102*c* and the projection 103 of the cylinder portion 102 align with two said vertical channels 201 provided on the inner annular side of the outer ring 20. To enable the bump 102*c* and the projection 103 to come into alignment with two said vertical channels 201, a user may rotate the movable lid 10 until the sign 101*a* of the movable lid 10 aligns with the sign 201*b* of the outer ring 20.

To couple the cover 1000 and the container 50 together, a user may bring the cover 1000 and the container 50 close to each other and press the cover 1000 so as for the upper circumferential serrate portion 101*b* of the movable lid 10 to engage with the lower circumferential serrate portion 301 of the inner lid 30. Then, the user may rotate the cover 1000 so as for the inner lid 30 and the container 50 to be coupled together and hermetically sealed.

Figure 7:
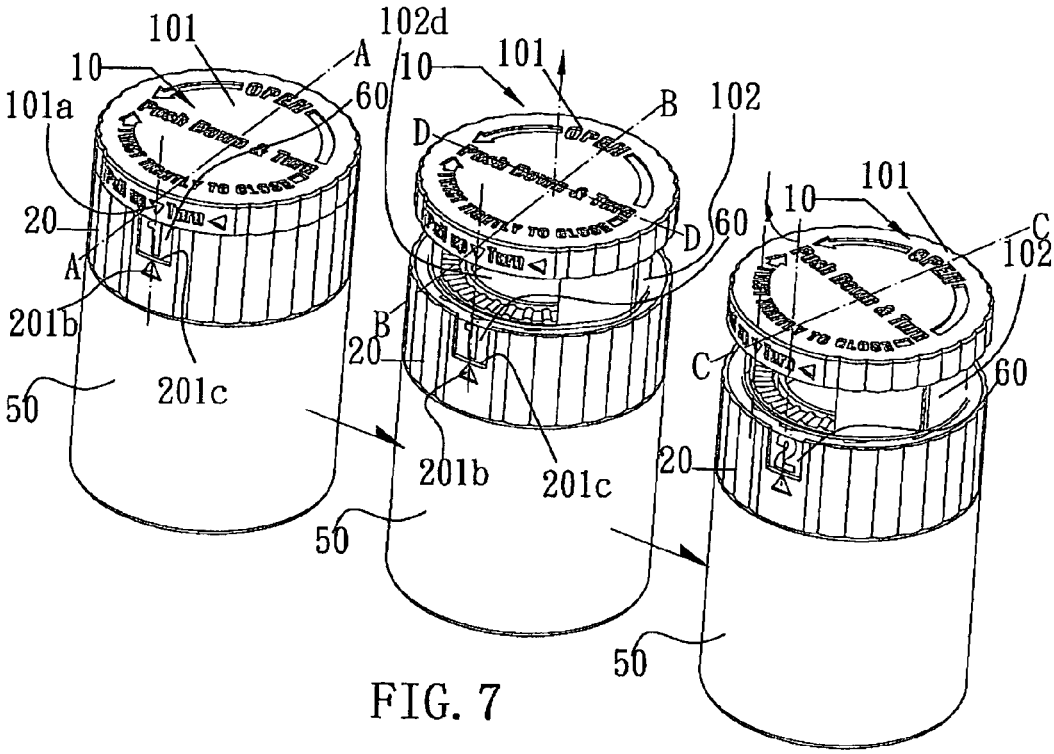
FIG. 7 is a perspective view of using a cover of a container according to the present invention.
Figure 8:
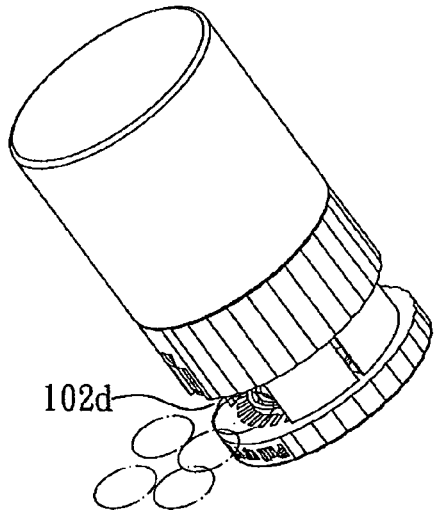
FIG. 8 is a schematic view of dispensing pills by a cover of a container according to the present invention.
Figure 11:
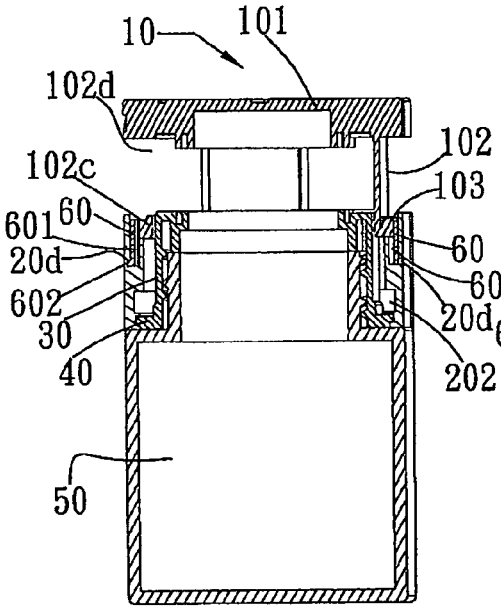
FIG. 11 is a cross-sectional view of a cover of a container taken along line C-C of FIG. 7 according to the present invention.
Figure 12:
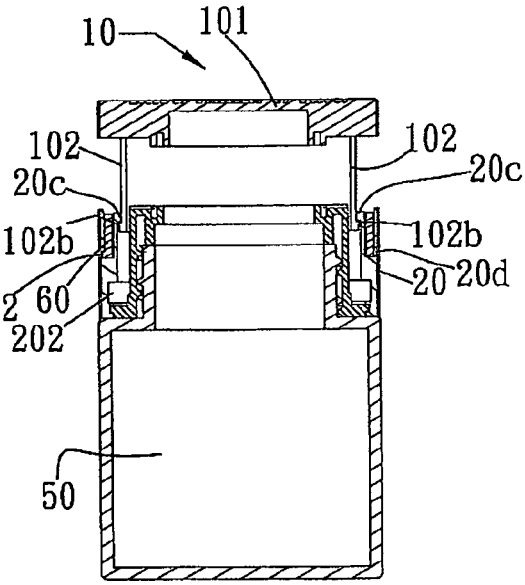
FIG. 12 is a cross-sectional view of a cover of a container taken along line D-D of FIG. 7 according to the present invention.

Referring to FIG. 7, which is a perspective view of using a cover of a container according to the present invention, to drawn pills from the container 50, a user has to rotate the movable lid 10 until the sign 101*a* protrudingly provided at the rim of the table portion 101 of the movable lid 10 aligns with the sign 201*b* of the outer ring 20. Referring to FIG. 9, the bump 102*c* and the projection 103 protrudingly provided at the bottom of the cylinder portion 102 of the movable lid 10 correspond in position to two said vertical channels 201 provided on the inner annular side of the outer ring 20, respectively. Referring to FIG. 10, the movable lid 10 is lifted to a positioning level, allowing the bump 102*c* and the projection 103 to engage with the barbs 601 protrudingly provided on the inner annular side of the symbol ring 60. Referring to FIG. 12, the flange 102*b* of the movable lid 10 abuts against the protruding top flange 20*c* provided at the upper portion of the inner annular side of the outer ring 20 and therefore is prevented from being released. Referring to FIG. 11, the movable lid 10 is slightly rotated so as for the projection 103 to drive the symbol ring 60 to rotate until the symbol ring 60 reaches a positioning position to thereby switch from one of the signs provided on the outer annular side of the symbol ring 60 to the next one of the signs (for example, switching from the sign 1 to the sign 2), and thus the next one of the signs is displayed through the notch 201*c* provided at the rim of the outer ring 20 to let the user know the number of times of use. As shown in the drawing, the bump 102*c* and the projection 103 protrudingly provided at the bottom of the cylinder portion 102 of the movable lid 10 are positioned within an insertion channel 201*a* transversely extending from the end of each of two said vertical channels 201, thus preventing the movable lid 10 from lowering. Referring to FIG. 8, pills are removed from the container 50 through the opening 102*d* provided on the front of the cylinder portion 102.

After the removal of a pill from the container 50, the user might want to leave the movable lid 10 shut. To do so, the user has to follow the aforesaid pill-taking steps in reverse order, that is, reverse operation. Performing the reverse operation comprises abutting the hook 20*b* protrudingly provided on the inner wall of the annular groove 20*a* of the outer ring 20 against the barbs 601 of the symbol ring 60 so as to prevent reverse rotation of the symbol ring 60 and limit the rotation of the symbol ring 60 to unidirectional rotation. Hence, performing the reverse operation leaves the symbol ring 60 unmoved and yet keeps the original sign so as for the original sign to be displayed through the notch 201*c* of the outer ring 20 to let the user know the number of times of use.

To draw a pill from the container 50 again, the user has to follow the aforesaid pill-taking steps again, which comprises rotating the symbol ring 60, switching from the current sign to the next sign (for example, switching from 2 to 3), and displaying the next sign through the notch 201*c* of the outer ring 20 to let the user know the number of times of use.

What is claimed is:

1. A cover of a container, comprising:

a movable lid, including:

a table portion;

a cylinder portion extending from a bottom of the table portion;

slits provided at diametric positions of the cylinder portion, respectively;

a flange provided at a bottom of the cylinder portion;

a bump protrudingly provided at the flange;

a projection protrudingly provided at the flange, wherein the bump and the projection are protrudingly provided at diametric positions of the flange, respectively;

an opening provided on a front of the cylinder portion; and a sign protrudingly provided at a rim of the table portion and vertically corresponding in position to the bump of the cylinder portion, wherein an upper circumferential serrate portion and a protruding ring are provided at the bottom of the table portion and enclosed by the cylinder portion;

an outer ring of an annular shape, the outer ring including:

an annular groove provided at a top of the outer ring;

an annular track indently provided on a bottom side of the annular groove;

a hook protrudingly provided on an inner wall of the annular groove;

two vertical channels indently provided at diametric positions on an inner annular side of the outer ring;

an insertion channel transversely extends from an end of each of the vertical channels;

an annular dent portion indently provided at a lower portion of the inner annular side of the outer ring;

a sign protrudingly provided at a rim of the outer ring;

a notch provided at the rim of the outer ring, wherein the sign and the notch correspond in position to the vertical channels; and a protruding top flange provided at an upper portion of the inner annular side of the outer ring;

a symbol ring, comprising:

a plurality of signs and bumps provided on an outer annular side of the symbol ring; and a plurality of barbs protrudingly provided on an inner annular side of the symbol ring and for being positioned in the annular groove of the outer ring; and an inner lid, including:

a lower circumferential serrate portion provided at a top of the inner lid;

an annular dent portion provided at an inner rim of the lower circumferential serrate portion; and an hollow core centrally provided in the inner lid; and an annular flange provided at a lower rim of the inner lid so as for the outer ring to rest on the annular flange of the inner lid, wherein the lower circumferential serrate portion is configured to engage with the upper circumferential serrate portion provided at the bottom of the table portion of the movable lid, and the annular dent portion is configured to engage with the protruding ring provided at the bottom of the table portion of the movable lid;

the cover being characterized by: the outer ring being of the annular shape and having the annular groove, the annular track provided on the bottom side of the annular groove, two opposing said vertical channels provided on the inner annular side of the outer ring, the insertion channel transversely extending from the end of each of the vertical channels, the hook protrudingly provided on the inner wall of the annular groove, and the annular dent portion indently provided at the lower portion of the inner annular side of the outer ring, the sign protrudingly provided at the rim of the outer ring and the notch provided at the rim of the outer ring wherein the sign and the notch correspond in position to the vertical channels;

the annular groove being configured to receive the symbol ring having the signs provided on the outer annular side of the symbol ring to allow a corresponding said barb protrudingly provided on the inner annular side of the symbol ring to abut against the hook protrudingly provided on the inner wall of the annular groove and to allow the bumps to be positioned in the annular track of the annular groove so as to enable unidirectional rotation of the symbol ring but prevent the release thereof;

the movable lid, the outer ring, and the symbol ring being coupled to the inner lid by inserting the cylinder portion of the movable lid into the inner lid and allowing the bump and the projection of the cylinder portion to engage with the annular dent portion indently provided at the lower portion of the inner annular side of the outer ring, thereby permitting axial rotation of the movable lid, preventing upward displacement of the movable lid as needed, and permitting upward displacement of the movable lid by rotating the movable lid until the bump and the projection of the cylinder portion of the movable lid aligned with two said vertical channels provided on the inner annular side of the outer ring; and the movable lid being rotated until the sign thereof corresponds in position to the sign of the outer ring to thereby allow the bump and the projection to correspond in position to two said vertical channels on the inner annular side of the outer ring, respectively;

in use, the movable lid being lifted to a positioning level to thereby allow the bump and the projection to engage with the barbs provided on the inner annular side of the symbol ring, and then the movable lid being slightly rotated so as for the projection to drive the symbol ring to rotate until the symbol ring reaches a positioning position to thereby switch from one of the signs provided on the outer annular side of the symbol ring to the next one of the signs and display the next one of the signs through the notch provided at the rim of the outer ring to show a number of times the cover has been used; and the bump and the projection at the bottom of the cylinder portion being positioned within the insertion channel transversely extending from the end of each of two said vertical channels to thereby prevent the movable lid from lowering, thus allowing a pill to be drawn from the container through the opening provided on the front of the cylinder portion.

* * * * *